US006375505B1

(12) United States Patent
Lin

(10) Patent No.: US 6,375,505 B1
(45) Date of Patent: Apr. 23, 2002

(54) ELECTRICAL CONNECTOR WITH TWO-PIECE SHIELD

(75) Inventor: Cheng Te Lin, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/444,475

(22) Filed: Nov. 22, 1999

(30) Foreign Application Priority Data

Nov. 20, 1998 (TW) ..... 87219246

(51) Int. Cl.[7] ..... H01R 13/648
(52) U.S. Cl. ..... 439/607; 439/108; 439/676
(58) Field of Search ..... 439/607, 608, 439/609, 95, 101, 108

(56) References Cited

U.S. PATENT DOCUMENTS

| | | | | |
|---|---|---|---|---|
| 4,689,723 A | | 8/1987 | Myers et al. | 361/424 |
| 5,035,650 A | * | 7/1991 | Defibaugh et al. | 439/609 |
| 5,288,248 A | | 2/1994 | Chen | 439/609 |
| 5,637,014 A | * | 6/1997 | Sukegawa et al. | 439/607 |
| 5,913,698 A | | 6/1999 | Keng | 439/609 |
| 5,954,540 A | | 9/1999 | Wu | 439/607 |
| 5,984,727 A | * | 11/1999 | Wu et all | 439/607 |
| 6,010,365 A | * | 1/2000 | Wu et al. | 439/607 |

FOREIGN PATENT DOCUMENTS

| | | | |
|---|---|---|---|
| JP | 8-222324 | 8/1996 | H01R/13/648 |
| WO | WO 98/57398 | 12/1998 | H01R/13/648 |

* cited by examiner

*Primary Examiner*—Hien Vu
(74) *Attorney, Agent, or Firm*—Robert J. Zeitler

(57) ABSTRACT

An electrical connector is provided which has first and second shields which fit over an insulative housing. Each of the two shields is generally U-shaped, having a central panel and a pair of opposed side panels. The two shields fit over the housing so that the two mating panels overlap. The side panels of the two shields are disposed against four respective sides of the housing, providing substantial shielding of the connector. Each of the side panels includes a mounting foot which extends from a bottom edge for mounting the connector to a circuit board. Each of the U-shaped shields may be formed from a generally strip-shaped blank, enabling an efficient use of materials with little waste.

17 Claims, 3 Drawing Sheets

ELECTRICAL CONNECTOR WITH TWO-PIECE SHIELD

BACKGROUND OF THE INVENTION

The present invention generally relates to the art of electrical connectors, and particularly relates to an electrical connector having an electromagnetic shield. A conventional connector generally includes an insulating housing, a receptacle defined within the housing, and a plurality of conductive terminals held by the housing within the receptacle, whereby a mating plug may be inserted into the receptacle for electrically contacting the terminals. The known housing is rectilinear in shape. Such a conventional connector additionally includes an electromagnetic shield which covers portions of the insulating housing.

One type of known shield covers a mating side and two opposite sides of the housing. This type of shield may be formed from a strip-shaped blank which is formed in a U-shape to cover the housing. This type of shield is inexpensive and requires little material to make. The two opposite sides of the shield each includes a respective retaining leg for mounting the connector to a circuit board. In particular, the two retaining legs may be inserted through respective apertures in the circuit board and secured by soldering. A connector having such a strip-shaped type of shield includes retaining legs located only at two lateral sides. Additionally, such a shield leaves two sides of the housing uncovered, providing those exposed sides with no shielding against electromagnetic interference. A connector utilizing such a strip-shaped shield may be suitable for certain applications wherein the connector subjected to minimal mechanical force and electromagnetic interference. Unfortunately, a connector having this configuration, having only two mounting legs, is known to loosen after a period of use in many applications, resulting in poor electrical contact with the circuit board or ultimately causing the connector to detach from the circuit board after repeated insertion and extraction of a mating connector.

The above mentioned mounting problem and lack of shielding coverage can be somewhat overcome by providing a shield which covers all four sides, as well as the mating side. Such a shield is formed from a cross-shaped blank cut from a sheet, having the mating panel located in a center of the cross-shaped blank, with each of the sides extending from its four sides. The shield is then shaped by bending each of the four sides perpendicularly. Unfortunately, this cross-shaped configuration increases the material used, thus increasing manufacturing costs. Substantially more material is wasted from a metal sheet from which cross-shaped shield blanks are cut as compared to a sheet from which strip-shaped shield blanks are cut. The increased amount of material used in making cross-shaped shield blanks inevitably increases the manufacturing costs.

SUMMARY OF THE INVENTION

The present invention overcomes the problems of prior connectors by providing an improved shield. Instead of cutting the shield blank in the shape of a cross, the shield of the invention is made from two strip-shaped members, thereby greatly reducing the amount of wasted material. Each of the strip-shaped members is bent in a U-shape forming a central mating panel and two sides panels perpendicularly extending therefrom. The two U-shaped shield members are secured over a generally or rectilinear housing such that each member covers two opposite side surfaces of the housing. Each of the four side panels may include a retaining leg. The central mating panels of the two shields overlap across a mating surface of the housing.

More specifically, in an embodiment, the present invention provides a shielded electrical connector including an insulative housing having a mating surface, a mounting surface, at least one side surface extending from the mating surface, and terminal cavities extending through the housing. Conductive terminals are disposed in the terminal cavities in the housing. Each of the terminals has a contact portion for mating with terminals of a mating connector and a tail portion for engaging conductors on a circuit board. Additionally, the connector includes a first conductive shield on the housing including a mating panel disposed on the mating surface of the housing and a side panel covering a side surface of the housing and a second conductive shield including a mating wall disposed on the mating panel of the first conductive shield and a side wall covering a side surface of the housing.

In an embodiment, the housing has a first pair of opposed sides and the first conductive shield has a pair of side panels that cover the first pair of opposed sides of the housing.

In an embodiment, the housing has a second pair of opposed sides and the second conductive shield has a pair of side walls that cover the second pair opposed sides. In an embodiment, outer edges of the side wall of the second conductive shield each includes a flange for engaging a side panel of the first conductive shield.

In an embodiment, outer edges of the side wall of the second conductive shield each includes a flange for insertion between the side panel of the first conductive shield and an adjacent side surface of the housing.

In an embodiment, the side panel of the first conductive shield includes a mounting foot for engagement with the circuit board.

In an embodiment, the side panel of the first conductive shield includes a ground contact for engaging a shield of a complementary mating connector.

In an embodiment, the side wall of the second conductive shield includes a mounting foot for engagement with the circuit board.

An advantage of the present invention is that it provides an electrical connector having electromagnetic shields that can be manufactured inexpensively with little waste of material.

Another advantage of the present invention is that it provides an electrical connector which is securely mountable to a circuit board.

A further advantage of the present invention is that it provides an electrical connector which has good electromagnetic shielding.

Yet a further advantage of the present invention is that it provides an electrical connector with a two-piece shield such that one of the two shielding elements can be removed to suit a particular low-cost application, yet which still provides partial electromagnetic shielding and means for mounting to a circuit board.

Additional features and advantages of the present invention are described in, and will be apparent from, the following detailed description, the claims and the Figures.

DETAILED DESCRIPTION OF PREFERRED EMBODIMENT

Figure 1:
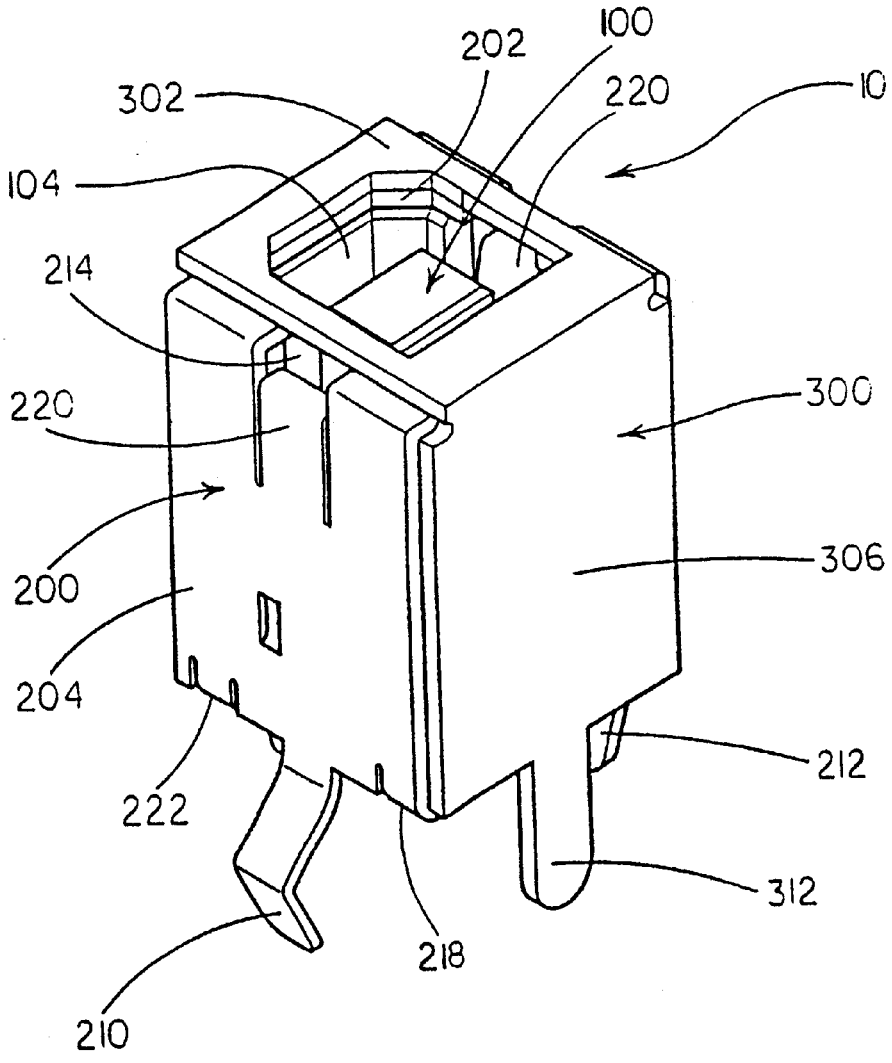
FIG. 1 is a perspective view of a connector according to an embodiment of the present invention in an assembled condition.
Figure 2:
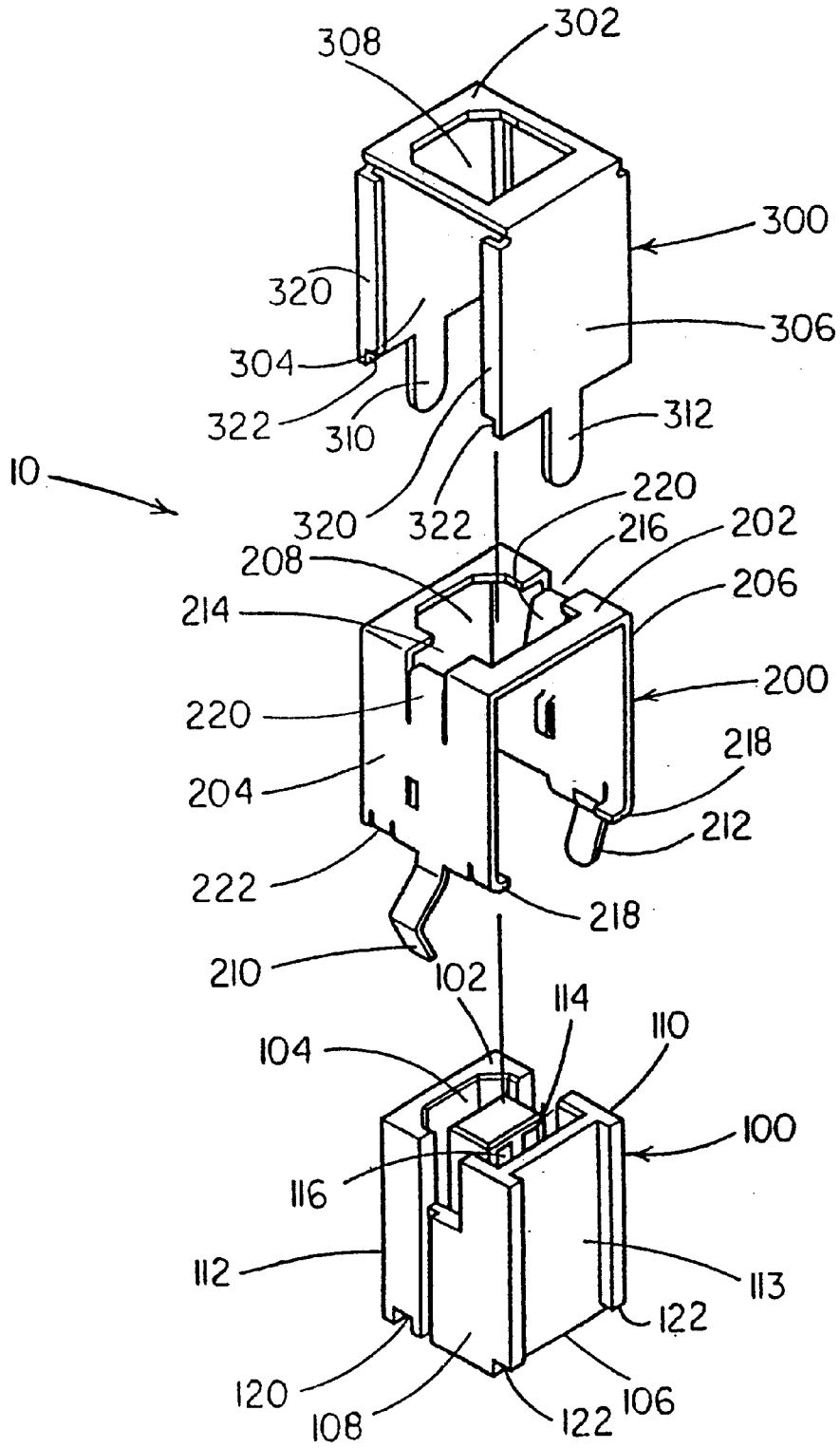
FIG. 2 is an exploded view of the connector of FIG. 1, showing the housing, first shield and second shield in an unassembled condition.
Figure 3:
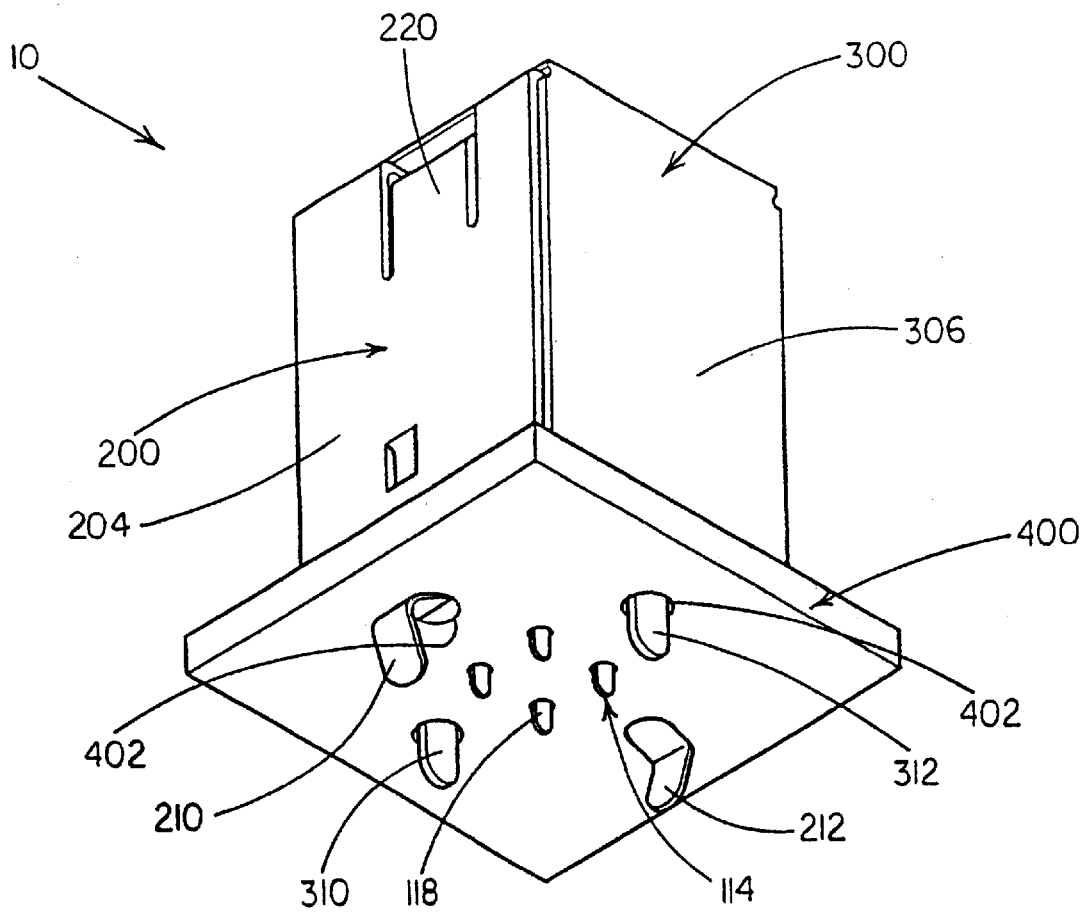
FIG. 3 is a perspective view of the assembled connector of FIG. 1 mounted to a circuit board.

Now referring to the drawings, wherein like numerals designate like components, FIGS. 1–3 illustrate a connector 10 constructed in accordance with teachings of the present invention. As illustrated in FIG. 1, the assembled connector is generally rectilinear in shape and is configured for receiving a mated plug (not shown).

As illustrated in FIGS. 1 and 2, the connector 10 includes an insulative housing 100, a first conductive shield 200 and a second conductive shield 300. The housing 100 has a mating surface 102, and the housing 100 defines a receptacle opening 104 at the mating surface 102 for receiving a mating plug (not shown). In the embodiment shown in FIG. 2, the housing 100 is generally rectilinear in shape, having a mounting surface 106 opposite the mating surface 102, a first side surface 108, a second side surface 110 opposite the first side surface 108, and opposite third and fourth side surfaces 112, 113.

The connector 10 further includes a plurality of conductive terminals 114 held within terminal cavities defined within the housing 100. Each of the conductive terminals 114 has a contact portion 116, as illustrated in FIG. 2, disposed within the receptacle opening for connecting with contacts of the mating plug. Additionally, as illustrated in FIG. 3, each of the terminals includes an opposite tail portion 118 which projects from the mounting surface 106 for engaging conductors of a circuit board 400. For providing electromagnetic shielding, the first shield 200 and second shield 300 fit over an exterior of the housing 100. Each of the shields 200, 300 is generally U-shaped and is formed from generally a strip-shaped blank that may be cut from a sheet (not shown) of stock conductive material. The strip shape of the two shields 200, 300 advantageously avoids wasting material, thereby leading to lower cost. More particularly, because of the strip shape of each of the shields 200, 300, many of the shields 200, 300 can be cut adjacently from a common sheet with a relatively small area of material being unused between the shields 200, 300.

As illustrated in FIG. 2, the first shield 200 includes a central mating panel 202 and a pair of first and second side panels 204, 206 that extend perpendicularly from opposite sides of the mating panel 202. An opening 208 is disposed in the mating panel shaped to provide plug access to the receptacle 104 in the housing 100. The first shield 200 fits over the housing 100 so that the mating panel 202 is disposed against the mating surface 102. The first and second side panels 204, 206 of the shield 200 are disposed against the first and second opposed sides 108, 110 of the housing, respectively. Tabs 218, 222 extending from a lower edge of said first and second side panels 204, 206 are bent around lower portions 122, 120, respectively, of the housing 100 to secure the shield 200 to the housing.

For mounting the connector 10, the first shield 200 includes a pair of mounting feet 210, 212 extending from bottom edges of the respective first and second side panels 204, 206. The mounting feet 210, 212 may be configured as insertable mounting legs, as illustrated, or surface-mount structures. The illustrated mounting legs 210, 212 are kinked to engage inner sides of a through hole in the circuit board.

In order to provide sure grounding contact between the connector 10 and the mated plug connector (not shown), the first shield 200 may optionally include grounding contacts 220. The grounding contacts 220 are strip-like projections cut and extending from the side panels 204, 206. The contacts 220 are bent in a spring like manner to contactably bias against a shield of an inserted plug connector. Slots 214, 216 are left in the central mating panel 202 where material is appropriated for the grounding contacts 220.

Referring to FIG. 2, the second shield 300 includes a central mating wall 302 and a pair of first and second side walls 304, 306 that extend perpendicularly from opposite sides of the mating wall 302. An opening 308 is disposed in the mating wall 302 and shaped to provide plug access to the receptacle 104 defined in the housing 100. The second shield 300 fits over a portion of the first shield 200 and the housing 100. More specifically, the mating wall 302 of the second shield is disposed against the mating panel 202 of the first shield 200 in an overlapping manner, and the first and second side walls 304, 306 are disposed against the opposed third and fourth sides 112, 113 of the housing, respectively. The mating wall 302 covers the slots 214, 216 in the central mating panel 202 of the first shield for improved shielding. Thus, the housing 100 is substantially shielded by the two shields 200, 300 covering the first through fourth lateral sides 108, 110, 112, 113 of the housing 100 as well as the mating surface 102.

Although the mating panel 202 and mating wall 302 of the shields 200, 300, respectively, overlap, the amount of overlapping material is favorable from a cost-of-manufacture perspective in comparison to the amount of waste experienced in producing cross-shaped shields. Advantageously, the overlapping panel 202 and wall 302 provide enhanced shielding of the mating surface 102.

To augment the mounting integrity of the connector 10, the second shield 300 includes a pair of mounting feet 310, 312 extending from bottom edges of the respective first and second walls 304, 306. The mounting feet 310, 312 may be configured as insertable mounting legs, as illustrated, or as surface-mount structures. The mounting feet 310, 312 of the second shield 200 provide enhanced mounting rigidity when the second shield is combined with the first shield 200, the connector 10 having four mounting feet 210, 212, 310 and 312.

As illustrated in FIG. 3, the four mounting feet 210, 212, 310 and 312 are insertable through associated apertures 402 in the circuit board 400. The mounting feet 210, 212, 310 and 312 are soldered in position to securely mount the connector 100 to the circuit board 400. The tail ends 118 of the conductive terminals 114 are illustrated extending through apertures 402 in the circuit board 400, although, in an embodiment, the tail ends could be configured for surface contact also.

In a particular application which does not require optimal mounting rigidity and/or shielding, the second shield 300 may be removed so that the connector 100 includes only the first shield 200 with two mounting feet 210, 212. The connector 100 may be selectively provided in either configuration with only one shield 200 or with both shields 200 and 300. This flexibility advantageously enables one design to satisfy multiple applications.

As illustrated in FIG. 2, in the illustrated embodiment of the second shield 300, each of the side walls 304, 306 includes a pair of flanges 320. Each flange 320 extends perpendicularly from a side edge of the respective wall 304, 306 to insert between the respective first and second side panels 204, 206 of the first shield 200 and respective first and second sides 108, 110 of the housing. Cut outs 322 in the lower edge of the flanges 320 accommodate tabs 218, 222 bent under the portions 122, 120 of the housing. The lateral fitting of the flange 320 between first and second side panels 204, 206 and first and second sides 108, 110 of the housing 100, respectively, and the longitudinal fitting of the flanges 320 between a lower surface of the central mating panel 202 and an upper surface of bent tabs 218, 222, respectively, assure that the second shield 300 will be well-secured to the first shield 200 and minimize electromagnetic interference leakage through the seams between the first and second shields.

Although the present invention has been described with reference to a preferred embodiment, it should be understood that the invention is not limited to the details thereof. Various changes and modifications to the described embodiment have been suggested in the foregoing description and others will be apparent to those of ordinary skill in the art. Such changes and modifications may be made without departing from the spirit and scope of the present invention. Therefore, all such changes and modifications are intended to be embraced within the scope of the invention as defined in the appended claims.

What is claimed is:

1. A shielded electrical connector comprising:

an insulative housing having a mating surface, a mounting surface, at least one side surface extending from said mating surface, and terminal cavities extending through said housing;

terminals disposed in said terminal cavities in said housing, said terminals having a contact portion for mating with terminals of a mating connector and tail portions for engaging conductors on a circuit board;

a first conductive shield on the housing including a mating panel disposed on said mating surface of said housing and a side panel covering substantially an entire side surface of said housing, said side panel includes a ground contact for engaging a shield of a complementary mating connector; and a second conductive shield including a mating wall disposed on the mating panel of the first conductive shield and a side wall covering substantially an entire side surface of said housing.

2. The connector of claim 1, wherein said housing has a first pair of opposed sides and said first conductive shield has a pair of side panels that cover substantially said entire first pair of opposed sides of said housing.

3. The connector claim 2, wherein said housing has a second pair of opposed sides and said second conductive shield has a pair of side walls that cover substantially said entire second pair of opposed sides.

4. The connector claim 3, wherein outer edges of said side wall of said second conductive shield each includes a flange inserted between a respective panel of said first conductive shield and an adjacent side surface of said housing.

5. The connector of claim 1, wherein outer edges of said side wall of said second conductive shield each includes a flange inserted between a respective side panel of said first conductive shield and an adjacent side of said housing.

6. The connector of claim 1, wherein said side panel of said first conductive shield includes a mounting foot for engagement with the circuit board.

7. The connector of claim 1, wherein said side wall of said second conductive shield includes a mounting foot for engagement with the circuit board.

8. The connector of claim 1 wherein said mating surface is opposed to said mounting surface.

9. A shielded electrical connector comprising:

an insulative housing having a mating surface, a mounting surface, a first pair of opposed side surfaces and a second pair of opposed side surfaces extending from said mating surface, and terminal cavities extending through said housing;

terminals disposed in said terminal cavities in said housing, said terminals having a contact portion for mating with terminals of a mating connector and tail portions for engaging conductors on a circuit board;

a first conductive shield on the housing including a mating panel disposed on said mating surface of said housing and a pair of opposed side panels covering substantially said entire first pair of opposed side surfaces of said housing, said side panels each including a ground contact for engaging a shield of a complementary mating connector; and a second conductive shield including a mating wall disposed on the mating panel of the first conductive shield and a pair of opposed side walls covering substantially said entire second pair of opposed side surfaces of said housing.

10. The connector of claim 9, wherein outer edges of each of said side walls of said second conductive shield include a flange for insertion between a respective one of said side panels of said first conductive shield and an adjacent side surface of said housing.

11. The connector of claim 9, wherein said side panels of said first conductive shield each include a mounting foot for engagement with the circuit board.

12. The connector of claim 9, wherein said side walls of said second conductive shield each include a mounting foot for engagement with the circuit board.

13. The connector of claim 9 wherein said mating surface is opposed to said mounting surface.

14. A shielded electrical connector comprising:

an insulative housing having a mating surface, a mounting surface opposed to said mounting surface, a first pair of opposed side surfaces and a second pair of opposed side surfaces extending from said mating surface and terminal cavities extending through said housing;

terminals disposed in said terminal cavities in said housing, said terminals having a contact portion for mating with terminals of a mating connector and tail portions for engaging conductors on a circuit board;

a first conductive shield on the housing including a mating panel disposed on said mating surface of said housing and a pair of opposed side panels covering said first pair of opposed side surfaces of said housing, at least one of said side panels including a ground contact for engaging a shield of a complementary mating connector; and a second conductive shield including a mating wall disposed on the mating panel of the first conductive shield and a pair of opposed side walls covering said second pair of opposed side surfaces of said housing.

15. The connector of claim 14, wherein said side panels of said first conductive shield each include a mounting foot for engagement with the circuit board.

16. The connector of claim 14, wherein said side walls of said second conductive shield each include a mounting foot for engagement with the circuit board.

17. The connector of claim 14, wherein outer edges of each of said side walls of said second conductive shield include a flange for insertion between a respective one of said side panels of said first conductive shield and an adjacent side surface of said housing.

* * * * *